US005354034A

United States Patent [19]

Simko

[11] Patent Number: 5,354,034

[45] Date of Patent: Oct. 11, 1994

[54] FOLDABLE CAR JACKING SYSTEM

[76] Inventor: Dennis Simko, 181 Park Rd., Painesville, Ohio 44077

[21] Appl. No.: 144,253

[22] Filed: Nov. 1, 1993

[51] Int. Cl.[5] ..... B66F 7/12

[52] U.S. Cl. ..... 254/89 R; 254/111; 254/133 R; 254/DIG. 3

[58] Field of Search ..... 254/45, 47, 89 R, 89H, 254/131, 133, 108, 111, DIG. 3

[56] References Cited

U.S. PATENT DOCUMENTS

| | | | |
|---|---|---|---|
| 1,206,361 | 11/1916 | Parker | 254/89 R |
| 2,012,430 | 8/1935 | Kuhlman | 254/89 R |
| 2,536,550 | 1/1951 | Hughes | 254/133 R |
| 3,881,689 | 5/1975 | Bury et al. | 254/45 |
| 4,082,250 | 4/1978 | Allmon et al. | 254/45 |
| 4,147,267 | 4/1979 | Mai | 254/45 |
| 4,375,934 | 3/1983 | Elliott | 254/108 |
| 4,479,634 | 10/1989 | Blatz | 254/133 R |

*Primary Examiner*—Robert C. Watson
*Attorney, Agent, or Firm*—Michael J. Colitz, Jr.

[57] ABSTRACT

A foldable jack system for lifting a car during the changing of a tire comprising a lower support bar formed of separable halves, each half having an intermediate end with hinge attachments formed of spaced holes mutually alignable to receive a bolt for coupling the halves, each half having a support block at its exterior end with a vertical recess at its upper end and a support plate at its lower end; an upper support bar formed of separable halves, each half having an interior end with a hinge attachment formed of spaced holes mutually alignable to receive a bolt for coupling the halves, each half having a jack block at its exterior end with a vertical aperture extending therethrough; a hook extension secured to each half of the upper support bar; a pair of rigid bars, each rigid bar having a lower end received in the recess of its associated support block and a series of teeth facing in a common direction; activating mechanisms including a jack crank for each jack block for raising and lowering the jack blocks, upper support bars, slide adapter and a common crank coupling the jack cranks for concurrent operation upon the actuating mechanism.

3 Claims, 4 Drawing Sheets

FOLDABLE CAR JACKING SYSTEM

BACKGROUND OF THE INVENTION

1. Field of the Invention

The present invention relates to a foldable car jacking system and more particularly pertains to a system adapted to raise two adjacent wheels of a car concurrently.

2. Description of the Prior Art

The use of car jacks is known in the prior art. More specifically, car jacks heretofore devised and utilized for the purpose of raising cars to change tires are known to consist basically of familiar, expected and obvious structural configurations, notwithstanding the myriad of designs encompassed by the crowded prior art which have been developed for the fulfillment of countless objectives and requirements.

Car jacks of the prior art take a large variety of form. By way of example, U.S. Pat. Nos. 3,606,254 and 3,627,269 both to Olson disclose generally conventional jacks with multiple support configurations.

U.S. Pat. No. 3,841,604 to Haines discloses a vertical jack support with a bumper engaging hook.

U.S. Pat. No. 3,049,011 discloses a one piece jack with a supplemental component movable beneath the wheel being raised.

Lastly, U.S. Pat. No. 3,810,603 to Metz discloses a jack wherein the raising is done through a thread screw.

None of the prior art references are directed to a foldable jack for lifting two adjacent wheels of a vehicle concurrently as is disclosed in the present invention.

In this respect, the foldable car jacking system according to the present invention substantially departs from the conventional concepts and designs of the prior art, and in so doing provides an apparatus primarily developed for the purpose of raising both sides of cars concurrently.

Therefore, it can be appreciated that there exists a continuing need for new and improved foldable car jacking system which can be used for raising two sides and two wheels of a car simultaneously. In this regard, the present invention substantially fulfills this need.

SUMMARY OF THE INVENTION

In view of the foregoing disadvantages inherent in the known types of car jacks now present in the prior art, the present invention provides an improved foldable car jacking system. As such, the general purpose of the present invention, which will be described subsequently in greater detail, is to provide a new and improved foldable car jacking system apparatus and method which has all the advantages of the prior art car jacks and none of the disadvantages.

To attain this, the present invention essentially comprises a foldable jack system for lifting a car during the changing of a tire comprising, in combination, a lower support bar formed of separable halves, each half having an intermediate end with hinge attachments formed of spaced holes mutually alignable to receive a bolt for coupling the halves and the nut for securing the bolt, each half having a support block at its exterior end with a vertical recess at its upper end and a support plate at its lower end and an adjustment bolt therebeneath; an upper support bar formed of separable halves, each half having an interior end with a hinge attachment formed of spaced holes mutually alignable to receive a bolt for coupling the halves and a nut for securing the bolt, each half having a jack block at its exterior end with a vertical aperture extending therethrough; a slide adjuster slidable secured to each half of the upper support bar and a hook extension extending outwardly and upwardly from each slide adjuster for positioning in a bumper hole of a car to be jacked; a pair of rigid bars, each rigid bar having a lower end received in the recess of its associated support block, each rigid bar having a series of teeth facing in a common direction opposite from the hook extension; activating mechanisms including a jack crank and release pin for each jack block for raising and lowering the jack blocks, upper support bars, slide adapters, the activating mechanisms also including a common hand crank coupling the jack cranks through parallel side bars and a common cross bar for concurrent operation upon the actuating mechanism, the release pin movable between a first orientation wherein the hand crank raises the jack blocks and a second orientation wherein the hand crank lowers the jack blocks.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foldable car jacking system which has all the advantages of the prior art car jacks and none of the disadvantages.

It is another object of the present invention to provide a new and improved foldable car jacking system which may be easily and efficiently manufactured and marketed.

It is a further object of the present invention to provide a new and improved foldable car jacking system which is of a durable and reliable construction.

An even further object of the present invention is to provide a new and improved foldable car jacking system which is susceptible of a low cost of manufacture with regard to both materials and labor, and which accordingly is then susceptible of low prices of sale to the consuming public, thereby making such foldable car jacking system economically available to the buying public.

Still yet another object of the present invention is to provide a new and improved foldable car jacking system which provides in the apparatuses and methods of the prior art some of the advantages thereof, while simultaneously overcoming some of the disadvantages normally associated therewith.

Still another object of the present invention is to jack up cars with greater safety.

Yet another object of the present invention is to simplify the changing of tires.

Even still another object of the present invention is to provide a new and improved foldable jack system for lifting a car during the changing of a tire comprising a lower support bar formed of separable halves, each half having an intermediate end with hinge attachments formed of spaced holes mutually alignable to receive a bolt for coupling the halves, each half having a support block at its exterior end with a vertical recess at its upper end and a support plate at its lower end; an upper support bar formed of separable halves, each half having an interior end with a hinge attachment formed of spaced holes mutually alignable to receive a bolt for coupling the halves, each half having a jack block at its exterior end with a vertical aperture extending therethrough; a hook extension secured to each half of the upper support bar; a pair of rigid bars, each rigid bar having a lower end received in the recess of its associated support block and a series of teeth facing in a common direction; activating mechanisms including a jack crank for each jack block for raising and lowering the jack blocks, upper support bars, slide adapter and a common crank coupling the jack cranks for concurrent operation upon the actuating mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
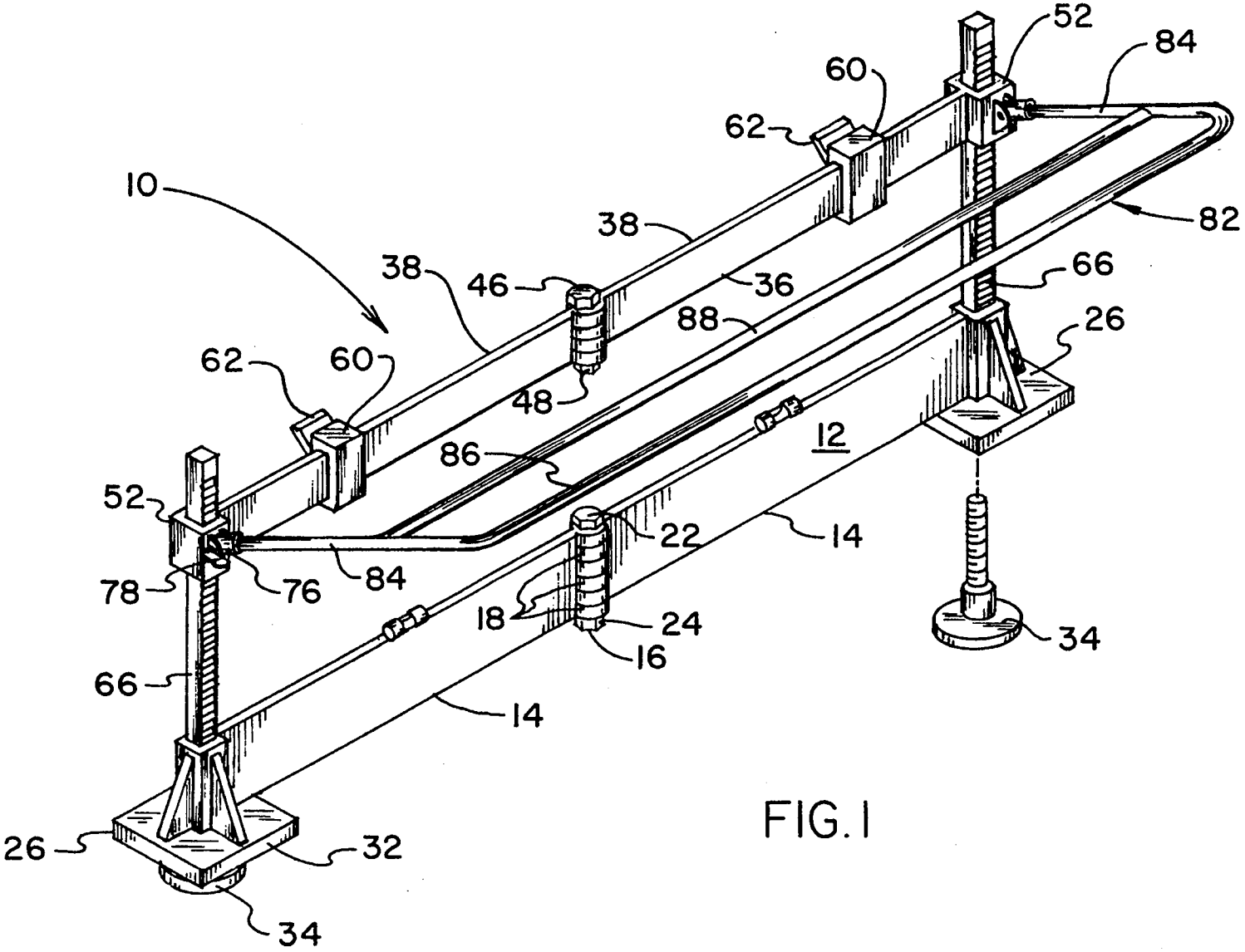
FIG. 1 is a perspective illustration of a foldable car jacking system constructed in accordance with the present invention.
Figure 2:
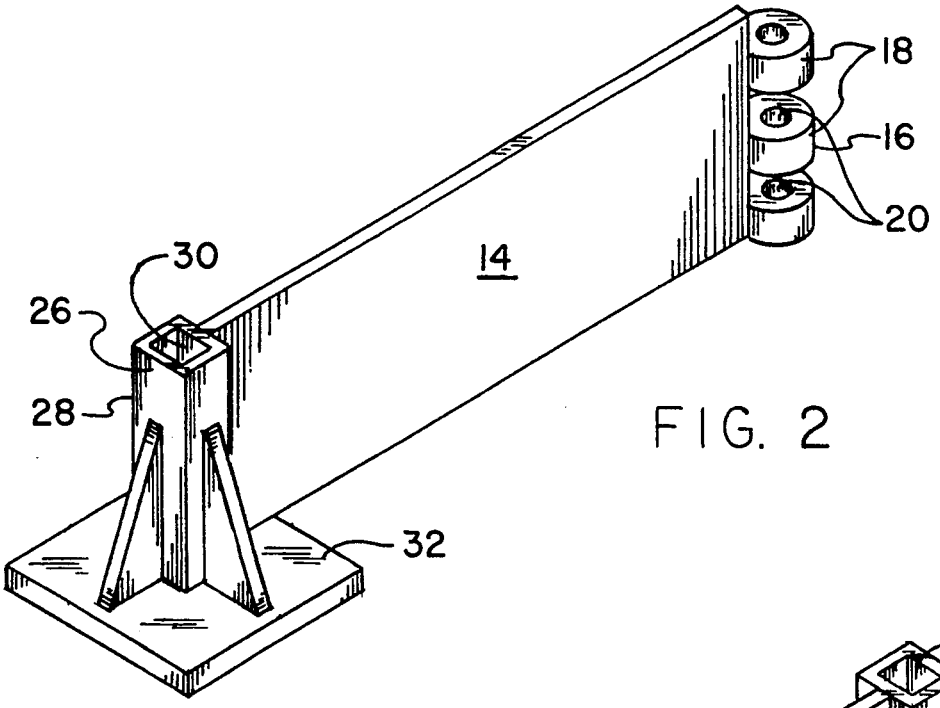
FIG. 2 illustrates a one half of the lower support rod of the system of FIG. 1.
Figure 3:
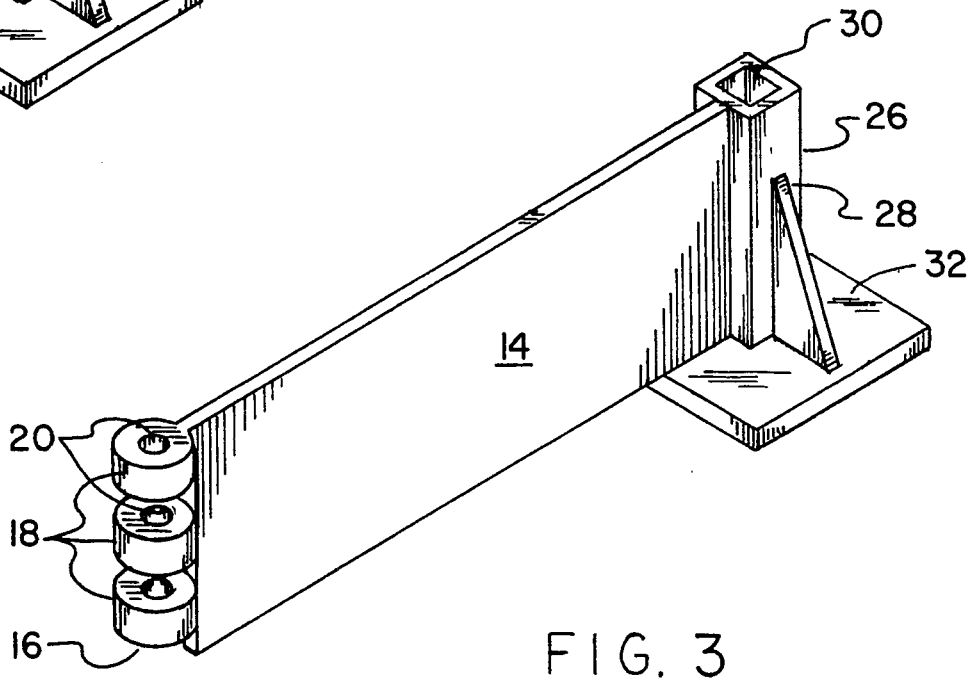
FIG. 3 is an illustration of FIG. 2 but showing the lower support rod half on the opposite side.
Figure 4:
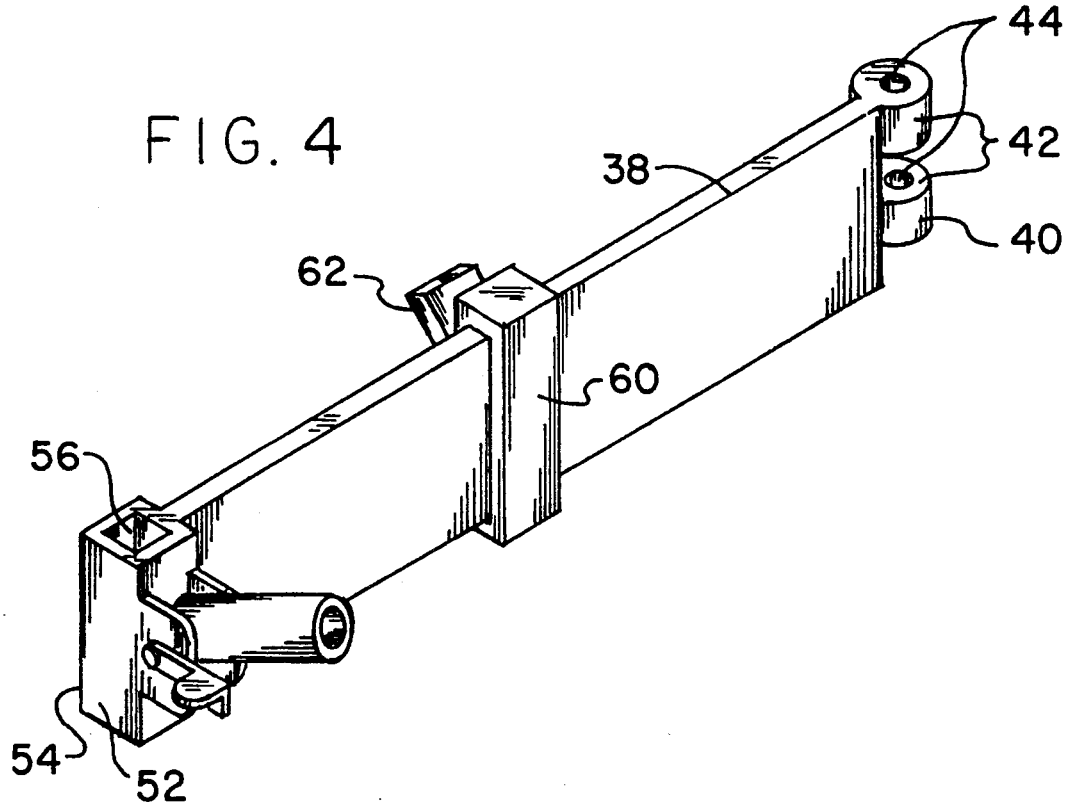
FIG. 4 is a perspective view of one half of the upper rod and associated components.
Figure 5:
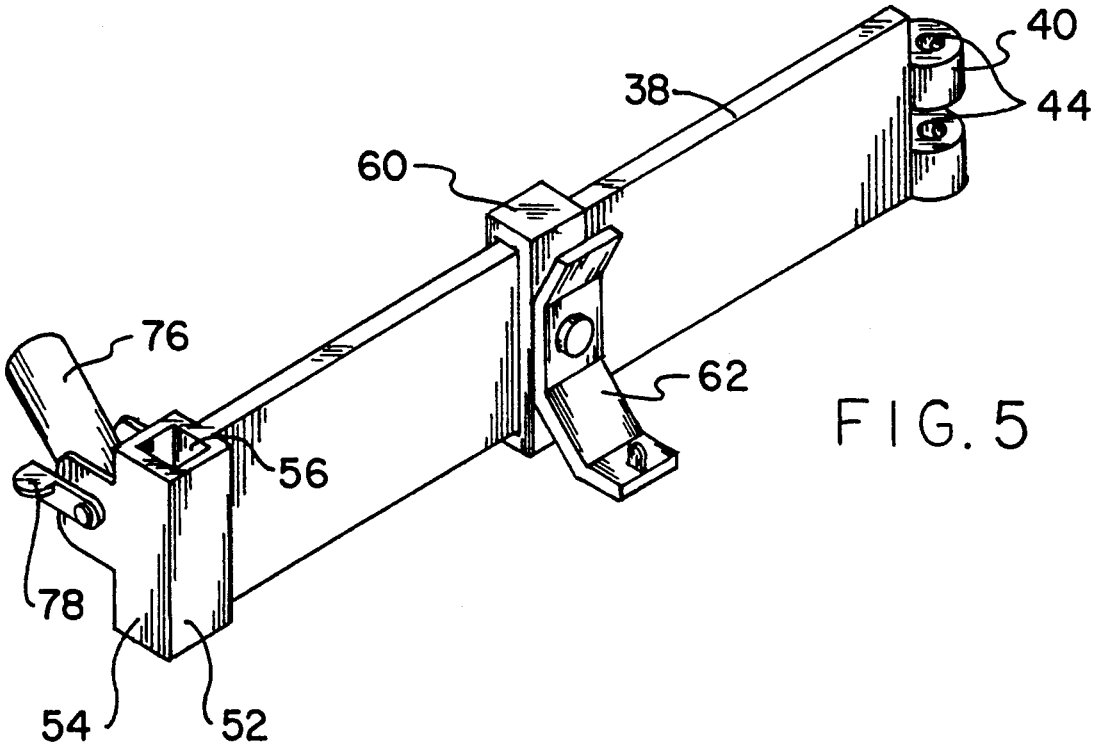
FIG. 5 is a perspective illustration of the other half of the upper support rod viewed from the opposite side.
Figure 6:
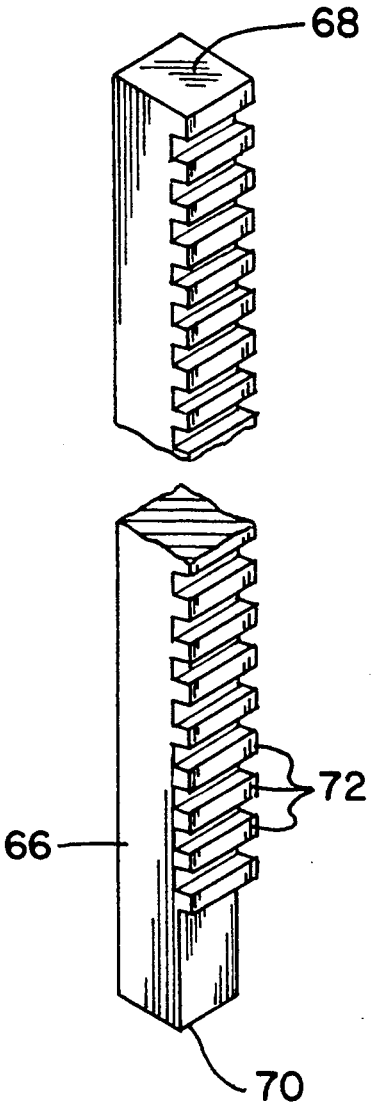
FIG. 6 is an illustration of the vertical rachet bar of FIG. 1.
Figure 7:
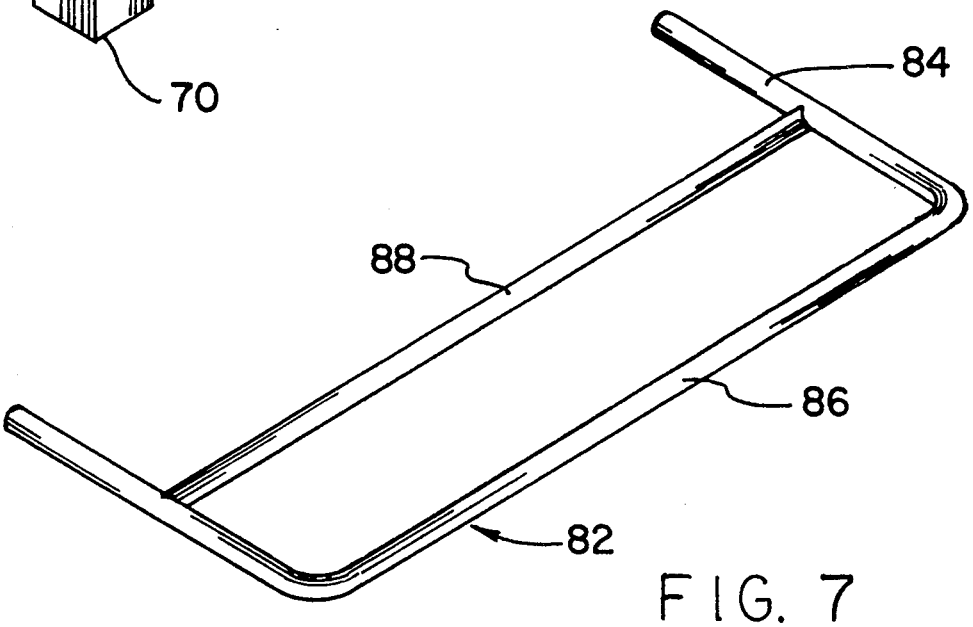
FIG. 7 is a perspective illustration of the crank bar of FIG. 1.

With reference now to the drawings, and in particular to FIG. 1 thereof, a new and improved foldable car jacking system embodying the principles and concepts of the present invention and generally designated by the reference numeral 10 will be described.

More specifically, FIG. 1 illustrates the overall jacking system 10 while FIGS. 2 through 7 illustrate the component elements thereof. The foldable jack system 10 is adapted for lifting two adjacent wheels of a car during the changing of a tire.

The system comprises, in combination, a lower support bar 12 formed of separable halves 14. Each half 14 of the lower support bar 12 is similarly shaped and has an intermediate end 16 with hinge attachments 18 formed of spaced holes 20. The holes of each half are mutually alignable to receive a bolt 22 for coupling the halves. A nut 24 is provided for securing each bolt.

Each half of the lower support bar also has a support block 26 at its exterior end 28 with a vertical recess 30 at its upper end. A support plate 32 is formed at its lower end. An adjustment bolt 34 is threadedly coupled to the plate 32 therebeneath to accommodate uneven road surfaces.

An upper support bar 36 formed of separable halves 38 is also provided. Each half 38 has at its interior end 40 a hinge attachment 42. Such hinge attachment is formed to include spaced holes 44 mutually alignable to receive a bolt 46 for coupling the halves. A nut 48 is also provided for securing the bolt. Each half has a jack block 52 at its exterior end 54. A vertical aperture 56 extends through the jack block 52.

Slidable secured to each half 38 of the upper support bar 36 is a slide adjuster 60. A hook extension 62 extends outwardly and upwardly from each slide adjuster 60 for positioning in bumper holes. Such bumper holes are normally parallel with each other at the front bumper or rear bumper of a car, not shown.

A pair of rigid bars 66 are also provided to extend in a vertical orientation parallel with each other. Each rigid bar 66 has a free upper end 68 and a lower end 70 received in the recess 30 of its associated support block 26. Each rigid bar 66 has a series of teeth 72 facing in a common direction opposite from the direction of the hook extension 62 for lifting and lowering the car is a step and repeat manner.

Jack activating mechanisms are employed to raise and lower a car as for changing a tire. Such mechanisms including a jack crank 76 and a release pin 78 for each jack block 52 for raising and lowering the jack blocks 52, upper support bar 36, slide adjuster 60. The activating mechanisms also include a common hand crank rod 82 releasably coupling the jack cranks 76 through parallel side bars 84 and common cross bars 86 and 88. This allows for concurrent operation upon the actuating mechanism.

The release pin 78 is essentially conventional in that it is movable between an upper orientation and a pivoted lower orientation. In one orientation, the cranking of the hand crank 82 up and down will raise the jack blocks 52 to raise a coupled car. In the other orientation, the cranking will lower the coupled car.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foldable jack system for lifting a car during the changing of a tire comprising, in combination:

a lower support bar formed of separable halves, each half having an intermediate end with hinge attachments formed of spaced holes mutually alignable to receive a bolt for coupling the halves and the nut for securing the bolt, each half having a support block at its exterior end with a vertical recess at its upper end and a support plate at its lower end and an adjustment bolt therebeneath;

an upper support bar formed of separable halves, each half having an interior end with a hinge attachment formed of spaced holes mutually alignable to receive a bolt for coupling the halves and a nut for securing the bolt, each half having a jack block at its exterior end with a vertical aperture extending therethrough;

a slide adjuster slidable secured to each half of the upper support bar and a hook extension extending outwardly and upwardly from each slide adjuster for positioning in a bumper hole of a car to be jacked;

a pair of rigid bars, each rigid bar having a lower end received in the recess of its associated support block, each rigid bar having a series of teeth facing in a common direction opposite from the hook extension;

activating mechanisms including a jack crank and release pin for each jack block for raising and lowering the jack blocks, upper support bars, slide adapters, the activating mechanisms also including a common hand crank coupling the jack cranks through parallel side bars and a common cross bar for concurrent operation upon the actuating mechanism, the release pin movable between a first orientation wherein the hand crank raises the jack blocks and a second orientation wherein the hand crank lowers the jack blocks.

2. A foldable jack system for lifting a car during the changing of a tire comprising:

a lower support bar formed of separable halves, each half having an intermediate end with hinge attachments formed of spaced holes mutually alignable to receive a bolt for coupling the halves, each half having a support block at its exterior end with a vertical recess at its upper end and a support plate at its lower end;

an upper support bar formed of separable halves, each half having an interior end with a hinge attachment formed of spaced holes mutually alignable to receive a bolt for coupling the halves, each half having a jack block at its exterior end with a vertical aperture extending therethrough;

a hook extension secured to each half of the upper support bar;

a pair of rigid bars, each rigid bar having a lower end received in the recess of its associated support block and a series of teeth facing in a common direction;

activating mechanisms including a jack crank for each jack block for raising and lowering the jack blocks, upper support bars, slide adapter and a common crank coupling the jack cranks for concurrent operation upon the actuating mechanism.

3. The system as set forth in claim 2 wherein the hooks are slideably positioned on the upper support bar with the hooks extending parallel to each other for coupling with parallel holes in the car.

* * * * *